US007939128B2

(12) United States Patent
Pedigo, Jr.

(10) Patent No.: US 7,939,128 B2
(45) Date of Patent: May 10, 2011

(54) STRENGTH LOSS INDICATOR FOR SYNTHETIC YARNS

(75) Inventor: John A. Pedigo, Jr., Greer, SC (US)

(73) Assignee: Southern Weaving Company, Greenville, SC (US)

( * ) Notice: Subject to any disclaimer, the term of this patent is extended or adjusted under 35 U.S.C. 154(b) by 847 days.

(21) Appl. No.: 11/983,660

(22) Filed: Nov. 13, 2007

(65) Prior Publication Data

US 2008/0060179 A1 Mar. 13, 2008

Related U.S. Application Data

(63) Continuation of application No. 10/778,414, filed on Feb. 16, 2004, now abandoned.

(51) Int. Cl.
*D06L 3/12* (2006.01)

(52) U.S. Cl. ..... 427/157; 427/8

(58) Field of Classification Search ..... 427/8, 157
See application file for complete search history.

(56) References Cited

FOREIGN PATENT DOCUMENTS

EP 1106449 * 6/2001

* cited by examiner

*Primary Examiner* — David Turocy
*Assistant Examiner* — James Lin
(74) *Attorney, Agent, or Firm* — Nelson Mullins Riley & Scarborough, LLP

(57) ABSTRACT

A webbing formed of synthetic yarns having an indicator for indicating exposure to ultraviolet light which results in strength loss of said synthetic yarns. The strength loss indicator comprises a strip extending along at least a portion of the webbing. The strip includes a phosphorescent material that produces a glow when exposed to ultraviolet light. The phosphorescent material is adapted to lose its ability to produce a glow over time exposure to ultraviolet light. Advantageously, the ability to glow fades at a rate correlated to the rate of loss of tensile strength of said synthetic yarns due to ultraviolet light exposure to indicate the condition of the webbing.

4 Claims, 1 Drawing Sheet

STRENGTH LOSS INDICATOR FOR SYNTHETIC YARNS

CROSS REFERENCE TO RELATED APPLICATION

This application is a continuation of application Ser. No. 10/778,414 filed Feb. 16, 2004 now abandoned.

FIELD OF THE INVENTION

The present invention relates to a webbing formed of synthetic yarns having an indicator for measuring exposure to ultraviolet light which results in strength loss of the synthetic yarns, and more particularly, to a phosphorescent strip included in the webbing that glows when exposed to ultraviolet light, and wherein the phosphorescent material loses its ability to produce a glow over time exposure to ultraviolet light, which is correlated to the rate of loss of tensile strength of the synthetic yarns due to ultraviolet light exposure to indicate the condition of the webbing.

BACKGROUND OF THE INVENTION

The prior art is replete with various inventions directed to the methods of providing phosphorescent textile fibers and used therefore. However, none of these inventions are directed to a phosphorescent indicator in which the luminescent properties decay at a predetermined rate corresponding to the ware of the product. Notably, many synthetic yarns are subject to molecular breakdown in the presence of ultraviolet light. The longer the exposure, the greater the loss of tensile strength in the synthetic yarns, such as nylon. Nothing in the prior art uses a phosphorescent indicator to correlate the exposure of synthetic yarns to ultraviolet light with the loss of tensile strength in the synthetic yarns as a result of the ultraviolet light exposure.

Accordingly, it is an object of the present invention to provide a phosphorescent indicator for webbings made of synthetic yarns which measure time exposure to ultraviolet light.

It is another object of the present invention to provide such a phosphorescent indicator for webbings in which the luminescent property of the indicator decay at a predetermined rate as a result of time exposure to ultraviolet light which is correlated to the molecular breakdown of the synthetic yarns to indicate the condition of the webbing.

SUMMARY OF THE INVENTION

The above objectives are accomplished according to the present invention by providing a webbing formed of synthetic yarns having an indicator for indicating exposure to ultraviolet light which results in strength loss of said synthetic yarns. In a preferred embodiment, the strength loss indicator comprises a strip extending along at least a portion of the webbing. The strip includes a phosphorescent material that produces a glow when exposed to ultraviolet light. The phosphorescent material looses its ability to produce a glow over time exposure to ultraviolet light. Advantageously, the ability to glow fades at a rate which may be correlated to the rate of loss of tensile strength of said synthetic yarns also due to ultraviolet light exposure to indicate the condition of the webbing.

Preferably, the webbing comprises fabrics which are one of woven, knitted, and non-woven. The fabrics are formed of synthetic yarns made of a thermoplastic polymer. In a preferred embodiment, the webbing comprises one of a safety harness, a tie-down, and a sling web. Other fabrics for other uses may also find the strength loss indicator useful.

Preferably, the strip comprises at least one synthetic yarn which includes phosphorescent material which is incorporated with the webbing. In a preferred embodiment, the strip includes a polyester yarn coated with the phosphorescent material. Alternatively, the strip may comprise a coating including the phosphorescent material applied to at least one surface of the webbing or the phosphorescent material may be incorporated in the synthetic material forming the yarn.

Preferably, the phosphorescent material includes a luminescent phosphor to provide the luminescent glow of the strip.

DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
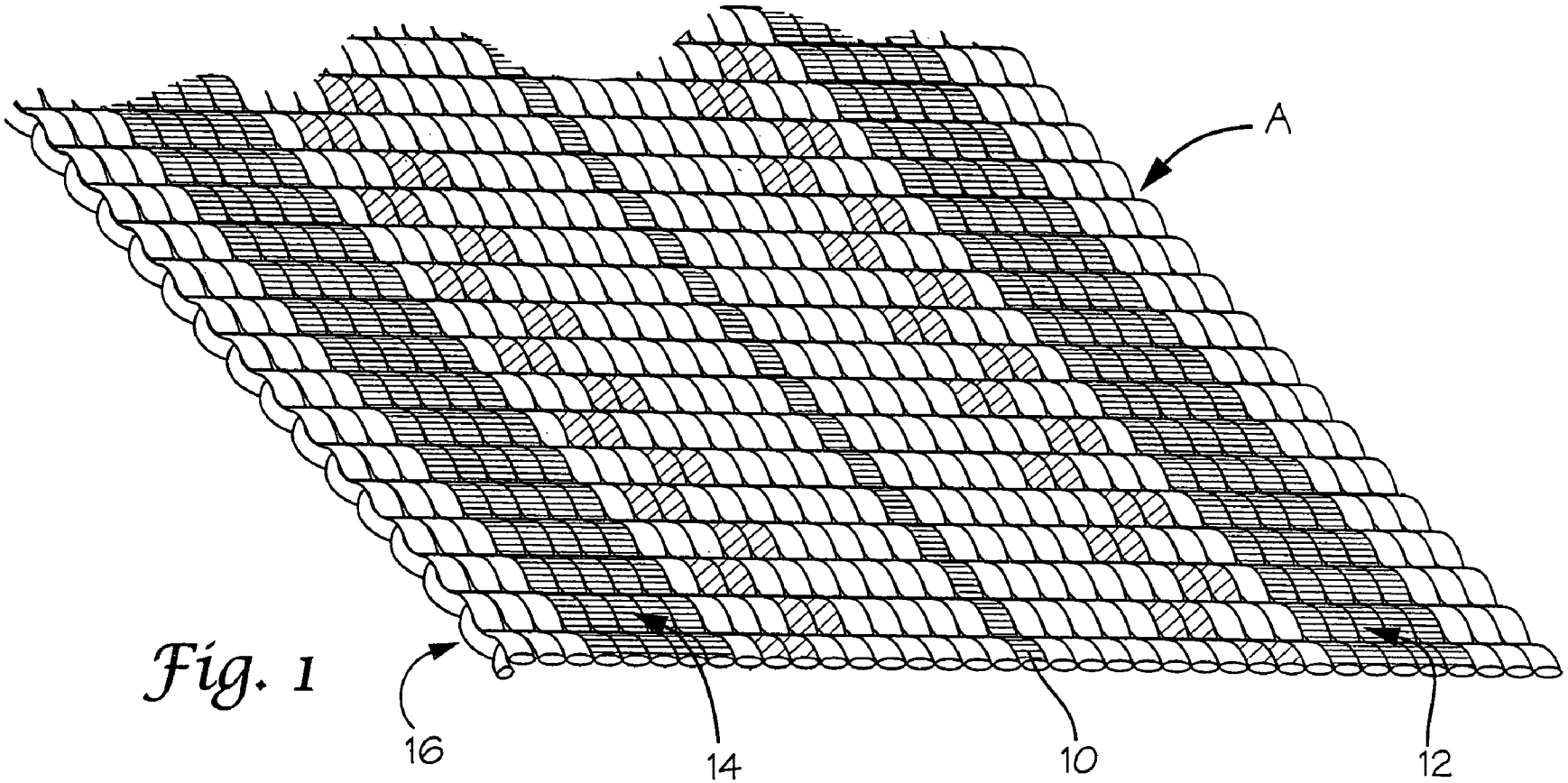
FIG. 1, the only figure, is a cutaway perspective view of a webbing according to the invention.

With reference to the drawing, the invention will now be described in more detail. FIG. 1 shows a section of webbing, designated generally as A, woven of synthetic yarns. It is to be understood that the webbing could be knitted or a non-woven. As shown, the webbing is a single layer fabric, however, multi-layer webbings also find utility with the indicator of the invention.

By way of example, the webbing is of the type commonly used to produce items such as a safety harness, a tie-down, and a sling web. It is well known that exposure to ultraviolet light causes significant breakdowns between the molecular bonds in the majority of commonly used synthetic yarns, such as nylon, polyester and Kevlar. Previously, there was no true way of measuring the ultraviolet damage or breakdown on webbings made of such materials. This can result in the dangerous overuse of products and particularly such products as industrial fabrics which may have lost the ability to support the original and intended loads due to exposure to ultraviolet light.

The present invention solves this problem by incorporating a strength loss indicator with webbing A for indicating the time of exposure to ultraviolet light which results in strength loss of the synthetic yarns. In a preferred embodiment, the strength loss indicator comprises a strip extending along the length of the webbing. The strip may comprise a single or a plurality of longitudinally extending yarns which include a phosphorescent material which produces a glow when exposed to ultraviolet light. The strip may be arranged along the fabric edge and comprise a single yarn at 16 or the single strip forming yarn may be arranged located in the body of the fabric as shown at 10. Alternatively, the strip may comprise a plurality of yarns as indicated at 12 or there may be a plurality of strips such as at 12 and 14.

Preferably, the phosphorescent material includes a luminescent phosphor, well known to those skilled in the art, which provides the luminescent glow of the strip. The phosphorescent material looses its ability to produce a glow over time exposure to ultraviolet light. Advantageously, this ability to glow fades at a rate which can be correlated to the rate of tensile strength loss of synthetic yarns also due to ultraviolet light exposure. In other words, the ability of the phosphorescent material of the strip to maintain its ability to glow after ultraviolet light exposure (also known as afterglow) decays due to exposure to ultraviolet light, at a pre-determined rate, which is in turn correlated to the degree of loss of tensile strength of the synthetic yarns due to ultraviolet light exposure. Accordingly, when the phosphorescent material of the strip no longer has the ability to maintain a glow due to ultraviolet light exposure, a predetermined loss of tensile strength of the synthetic yarns for the given exposure has also occurred. Accordingly, appropriate action can be taken to replace the deteriorated webbing with new webbing.

For example, a strip including the phosphorescent material can be incorporated into the webbing of a safety strap made of nylon. After approximately 2000 xion hours of ultraviolet light exposure, the tensile strength of the nylon and consequently the webbing will be reduced by approximately 40%. At this point the strap is considered no longer safe for use. The phosphorescent material incorporated in the strip in this particular embodiment is manufactured to maintain its glowing ability for approximately 2000 xion hours, which corresponds with a loss of tensile strength of the nylon webbing of about approximately 40%. The properties of the phosphorescent material in the strip described above can be adjusted and varied accordingly to indicate any desired amount of ultraviolet light exposure for a given percentage of tensile strength loss for any specific synthetic yarn or combination of synthetic yarns. It is known to those skilled in the art to produce such phosphorescent materials to maintain an afterglow for a given and variable time period or exposure to ultraviolet light. One such company capable of producing phosphorescent materials with the desired characteristics necessary to practice the present invention is Fiber-Line, Inc., 3050 Campus Drive, Hatfield, Pa. 19440.

Preferably, the strip is formed of at least one synthetic yarn which includes the phosphorescent material and is incorporated along with the other synthetic yarns during formation of the webbing. As earlier described, a strip, as indicated by reference number 10, may comprise a single polyester yarn coated with the phosphorescent material which is woven into the webbing. A strip as indicated at 10, 12, 14 or 16 may be formed by simply applying a coating of the phosphorescent material on to the webbing after the manufacturing process.

As earlier stated, the webbing is formed by one of woven, knitted, and non-woven synthetic yarns made of a thermoplastic polymer in which the tensile strength degrades when exposed to ultraviolet light. The webbing may be formed in a single layer or in multi-layers depending upon the desired use and strength requirements. Examples of synthetic thermoplastic polymers likely to be used in form the webbing include polyamides, polyesters, polypropylene, polyethylene, polyacrylates, polycarbonates, polycyanoethylenes, polyacrylonitrides, polyvinyl chloride, polymethacrylics, polystyrene, polyurethane, acrylate resins, halogenated polymers, and mixtures and blends thereof. The composition of the phosphorescent material of the strip is adapted to the specific chemistry for the specific thermoplastic polymer used to form the webbing. Thus, the afterglow decay rate of the phosphorescent material is adjusted to correspond to the molecular breakdown of the thermoplastic polymer from ultraviolet light exposure to indicate a known tensile strength for a given time of ultraviolet light exposure when the phosphorescent material no longer glows.

While a preferred embodiment of the invention has been described using specific terms, such description is for illustrative purposes only, and it is to be understood that changes and variations may be made without departing from the spirit or scope of the following claims.

What is claimed is:

1. A method of forming an industrial webbing with a degradation detector for detecting degradation of yarns forming said webbing due to exposure to ultraviolet rays including:

selecting synthetic yarns which degrade at a known rate over a known time period from exposure to ultraviolet rays and fabricating said synthetic yarns into said industrial webbing;

selecting a phosphorescent which has an ability to glow which diminishes over a known period of time and at a known rate when exposed to ultraviolet rays and correlating the time and rate of diminishing ability to glow of the phosphorescent with the time and rate of strength loss of said synthetic yarns;

incorporating said selected phosphorescent with said webbing at least along its length;

exposing said webbing including said phosphorescent to ultraviolet rays causing said ability to glow to diminish as said synthetic yarns begin degradation from exposure to ultraviolet rays, with said diminishing of said ability to glow to a pre-selected level indicating degradation of said synthetic yarns to an unsafe degree.

2. The method of claim 1 including coating at least one of said synthetic yarns with said phosphorescent and locating said coated yarn length of said fabric.

3. The method of claim 1 including incorporating said phosphorescent with said webbing by coating along at least one surface of said webbing.

4. The method of claim 1 including forming a fabric strip of yarns containing said phosphorescent and securing said fabric strip with said webbing.

* * * * *